US011767196B2

(12) United States Patent
Cambruzzi et al.

(10) Patent No.: US 11,767,196 B2
(45) Date of Patent: Sep. 26, 2023

(54) ASSEMBLY DEVICE FOR CARRYING OUT ASSEMBLY STEPS ON A WALL AND METHOD FOR ARRANGING A MAGAZINE COMPONENT ON AN ASSEMBLY DEVICE

(71) Applicant: Inventio AG, Hergiswil (CH)

(72) Inventors: Andrea Cambruzzi, Zürich (CH); Oliver Simmonds, Lucerne (CH); Philipp Zimmerli, Härkingen (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/760,111

(22) PCT Filed: Feb. 1, 2021

(86) PCT No.: PCT/EP2021/052238

§ 371 (c)(1),
(2) Date: Aug. 4, 2022

(87) PCT Pub. No.: WO2021/160447

PCT Pub. Date: Aug. 19, 2021

(65) Prior Publication Data

US 2023/0041465 A1 Feb. 9, 2023

(30) Foreign Application Priority Data

Feb. 11, 2020 (EP) ..... 20156561

(51) Int. Cl.
*B66B 19/00* (2006.01)

(52) U.S. Cl.
CPC ..... *B66B 19/002* (2013.01)

(58) Field of Classification Search
CPC ..... B66B 19/00; B66B 19/002
See application file for complete search history.

(56) References Cited

U.S. PATENT DOCUMENTS

2012/0217101 A1* 8/2012 Peacock ..... B66B 11/0045 29/428
2012/0291395 A1* 11/2012 Plathin ..... B66B 19/02 52/741.1

(Continued)

FOREIGN PATENT DOCUMENTS

JP H04213580 A 8/1992
WO 2017016780 A1 2/2017

(Continued)

*Primary Examiner* — Michael A Riegelman
(74) *Attorney, Agent, or Firm* — William J. Clemens; Shumaker, Loop & Kendrick, LLP

(57) ABSTRACT

An assembly device for carrying out assembly steps on a wall and a method for arranging a magazine component on a magazine housing device include a mobile assembly frame, a mechatronic installation component, the magazine housing device, magazine components and a securing device. The magazine housing device houses the magazine components with assembly means housed therein. The securing device, in a securing state, establishes a connection between the magazine components and the assembly frame to secure the magazine components against displacement relative to the assembly frame. The magazine components each have a first coupling element and the securing device has a second coupling element. The first coupling element and the second coupling element are arranged such that the securing device can be detachably coupled to the magazine components by the two coupling elements.

15 Claims, 3 Drawing Sheets

(56) References Cited

U.S. PATENT DOCUMENTS

| | | | | |
|---|---|---|---|---|
| 2014/0000987 | A1* | 1/2014 | Peacock | B66B 9/187 187/414 |
| 2018/0208439 | A1* | 7/2018 | Studer | B66B 11/0005 |
| 2019/0276277 | A1* | 9/2019 | Christen | B66B 19/00 |
| 2020/0055709 | A1* | 2/2020 | Cambruzzi | B66B 19/002 |
| 2020/0180912 | A1* | 6/2020 | Li | B66B 11/0446 |
| 2020/0277158 | A1* | 9/2020 | Christen | B66B 5/284 |
| 2020/0299105 | A1* | 9/2020 | Cambruzzi | B66B 19/002 |
| 2020/0377339 | A1* | 12/2020 | Cambruzzi | G01C 15/004 |
| 2021/0130136 | A1* | 5/2021 | Cambruzzi | B66B 19/00 |
| 2021/0139286 | A1* | 5/2021 | Cambruzzi | B66B 19/002 |
| 2021/0156666 | A1* | 5/2021 | Cambruzzi | B66B 19/00 |
| 2021/0323793 | A1* | 10/2021 | Cambruzzi | B66B 19/00 |
| 2022/0009006 | A1* | 1/2022 | Cambruzzi | G05B 19/402 |
| 2022/0185631 | A1* | 6/2022 | Lanz | E04G 3/32 |
| 2022/0380177 | A1* | 12/2022 | Cambruzzi | B66B 19/00 |
| 2022/0380178 | A1* | 12/2022 | Cambruzzi | B66B 7/024 |
| 2023/0041465 | A1* | 2/2023 | Cambruzzi | B66B 19/00 |
| 2023/0049422 | A1* | 2/2023 | Achermann | B62B 3/02 |
| 2023/0094665 | A1* | 3/2023 | Cambruzzi | B25J 11/005 483/1 |

FOREIGN PATENT DOCUMENTS

| | | | | |
|---|---|---|---|---|
| WO | 2018177888 | A1 | 10/2018 | |
| WO | WO-2021144154 | A1 * | 7/2021 | B62B 3/02 |

* cited by examiner

ASSEMBLY DEVICE FOR CARRYING OUT ASSEMBLY STEPS ON A WALL AND METHOD FOR ARRANGING A MAGAZINE COMPONENT ON AN ASSEMBLY DEVICE

FIELD

The invention relates to an assembly device for carrying out assembly steps on a wall and a method for arranging a magazine component on a magazine housing device of an assembly device.

BACKGROUND

WO 2018/177888 A1 describes an assembly device for carrying out assembly steps on a wall in the form of a shaft wall of an elevator shaft of an elevator system. The assembly device has a mobile assembly frame in the form of a carrier component, a mechatronic installation component in the form of an industrial robot, a magazine housing device, a magazine component and a securing device. The mechatronic installation component and the magazine housing device are arranged on the assembly frame. The magazine housing device is intended to house the magazine component with assembly means housed therein, for example in the form of screws or anchor bolts, wherein assembly means can be removed from the magazine component by means of the mechatronic installation component when an assembly step is being carried out. The securing device is designed and arranged in such a way that, in a securing state, it secures the magazine component housed by the magazine housing device against displacement relative to the assembly frame. For this purpose, the base of the magazine component can have a depression in which rollers of a magazine component are arranged when the magazine housing device is being loaded. As an alternative to this, a hole can be provided in the base of the magazine component, and a pin designed as a fixed part of the magazine component penetrates into the hole when the magazine housing device is being loaded.

SUMMARY

In contrast, an object of the invention is, in particular, to provide an assembly device for carrying out assembly steps on a wall and a method for arranging a magazine component on a magazine housing device of an assembly device, which can be used flexibly and can enable a magazine component to be reliably secured on a magazine housing device. According to the invention, this object is achieved by an assembly device having the features and a method having the features described below.

The assembly device according to the invention for carrying out assembly steps on a wall has a mobile assembly frame, a mechatronic installation component, a magazine housing device, a magazine component and a securing device. The mechatronic installation component and the magazine housing device are arranged on the assembly frame. The magazine housing device is intended to house the magazine component with assembly means housed therein, wherein assembly means can be removed from the magazine component when an assembly step is being carried out by means of the mechatronic installation component. The securing device is designed and arranged in such a way that in a securing state it establishes a connection between the magazine component and the assembly frame and thus secures the magazine component housed by the magazine housing device against displacement relative to the assembly frame.

According to the invention, the magazine component has a first coupling element and the securing device has a second coupling element. The first coupling element and the second coupling element are designed and arranged in such a way that the securing device can be detachably coupled to the magazine component by means of the two coupling elements. The securing device can thus only be arranged on a magazine component when this component is to be arranged on a magazine housing device and secured against displacement. It is therefore not necessary to provide a securing device on every magazine component that could be arranged on the magazine housing device, which would incur costs, take up space and increase the weight of a magazine component. A small space requirement and a low weight of a magazine component are particularly advantageous for transporting the magazine component. If more than one magazine component is to be arranged on the magazine housing device, then it is advantageously possible for a securing device, by means of which all magazine components arranged on the magazine housing device can be secured, to be arranged on only one magazine component. The magazine components thus require as little space as possible on the magazine housing device. In addition, the lowest possible weight of the assembly device can thus be achieved, which enables simple handling of the assembly device.

The assembly device can carry out assembly steps on a wall at least partially automatically. It has, for example, a percussion drill which is housed by the mechatronic installation component and by means of which holes can be drilled in a wall in an automated manner. It may also include a jig for hammering anchor rods into boreholes into which anchor rods can be driven into previously drilled holes in a wall.

The assembly device can, in particular, carry out assembly steps in an automated manner, in particular for the assembly of an elevator system in an elevator shaft. However, other purposes are also possible, for example assembly steps when cables are being laid or when ventilation pipes are being fitted.

The wall is designed, in particular, as a wall in a building, wherein a floor or a ceiling in a building may also be regarded as a wall. It is designed, in particular, as a shaft wall of an elevator shaft of an elevator system. However, the wall can also be arranged, for example, on or in a bridge, a pillar or a ship. The wall consists, in particular, of concrete strengthened with reinforcements.

The assembly frame is designed so that it can be displaced, for example brought to different heights in a vertical shaft, or can be simply transported from one place of use to another place of use. Thus, it is not part of a machine that is fixed in an assembly hall in order to carry out assembly steps there. The assembly frame can thus be referred to as a mobile assembly frame. In particular, it has a rigid basic structure, for example made of metal profiles, to which the mechatronic installation component and the magazine housing device are fastened. The assembly frame can also have one or more fixing components, by means of which it and thus the assembly device can be fixed at their place of use, for example a specific position in an elevator shaft. The assembly frame can be designed, for example, corresponding to a carrier component of WO 2017/016780 A1.

The mechatronic installation component is designed, in particular, as an industrial robot. It can be designed, for example, corresponding to a mechatronic installation component described in WO 2017/016780 A1. However, other designs of the mechatronic installation component are also possible. For example, the mechatronic installation component can have only one arm that can be moved in and out in one direction by means of an actuator.

A magazine component can house assembly means. Assembly means are to be understood here, in particular, as parts that are arranged on the wall during an assembly step, for example screws and anchor bolts, but also tools such as drill bits for a percussion drill that are used in an assembly step. A magazine component has, for example, a base frame that carries a housing plate with many openings into which the assembly means can be inserted from above and can be removed while an assembly step is being carried out. The magazine component has, in particular, a mainly cuboid basic shape, wherein it is possible for rollers to be arranged on the base frame so that the magazine component can be pushed easily. In particular, the magazine component consists mainly of metal.

The magazine component has, in particular, a foam layer in the base frame and below the housing plate. The foam layer has holes aligned with the openings of the housing plate. The foam layer ensures correct alignment of the assembly means inserted into the openings, for example perpendicular to the housing plate. Correct alignment is important so that the mechatronic installation component can reliably house the assembly means. The diameter of the holes in the foam layer and the type of foam must be adapted to the particular design of the assembly means. The provision of the foam layer is independent of the provision of a securing device that can be coupled and uncoupled and can be regarded as an independent invention.

The magazine housing device is designed in such a way that it can house at least one magazine component. For example, it can have a platform or a base onto which magazine components can be placed or pushed. The magazine housing device has, in particular, two parallel arms, each of which has a support surface on which a magazine component can be supported, in particular via its rollers. When a magazine component is placed on the magazine housing device, rollers of the magazine component can roll on the aforementioned support surfaces. The magazine component can thus be arranged between the two arms.

In its securing state, the securing device prevents the magazine component from moving relative to the magazine housing device. On the one hand, this prevents the magazine component from detaching from the magazine housing device and, in the worst case, falling down during a displacement of the assembly device or while an assembly step is being carried out. In addition, the securing device ensures that the magazine component and thus also the assembly means it houses are located in a defined position within the assembly frame. This enables the mechatronic installation component to reliably house a desired assembly means.

In its securing state, the securing device establishes a connection between the magazine component and the assembly frame, in particular indirectly. In particular, it establishes a connection between the magazine component and the magazine housing device, which is arranged on the assembly frame and is therefore connected to the assembly frame. In particular, the securing device establishes a form-fitting connection to the assembly frame or the magazine housing device. For this purpose, for example in the securing state, two bolts of the securing device can penetrate into corresponding recesses in the magazine housing device and thus can establish a positive connection between the securing device and the magazine housing device. The securing device can, for example, have an elongated, mainly cuboid main body. The two bolts are arranged, in particular, on a side of the main body that is oriented in the direction of the magazine housing device. If the magazine housing device has two parallel arms as described above, the bolts are arranged on two opposite sides of the main body and the securing device is arranged between the two arms in the securing state.

The securing device can assume a release state in addition to the securing state. In the release state, it does not establish a connection between the magazine component and the assembly frame. In the release state, for example, the aforementioned bolts are retracted so that they do not penetrate into the aforementioned recesses in the magazine housing device. In this example, in order to set the securing state, starting from the release state and a corresponding position of the securing device relative to the magazine housing device, the two bolts are extended in the direction of the recesses so far that the bolts penetrate into the recesses and thus create a positive connection between the magazine component and magazine housing device. Changing the two states of the securing device, for example extending and retracting the aforementioned bolts, is carried out manually, in particular by a fitter. An actuator, for example in the form of an electric spindle drive, can also be provided for this purpose.

The securing device can be detachably coupled to a magazine component. This is to be understood here as meaning that the securing device can be coupled to and decoupled from a magazine component easily and, in particular, manually. The coupling and decoupling can take place, in particular, without the use of a tool, such as a wrench or a screwdriver. In particular, the securing device is coupled to the magazine component before the magazine component is arranged on the magazine housing device. The decoupling takes place, in particular, after the magazine component has been removed from the magazine housing device.

When the securing device is coupled to a magazine component, a connection, in particular a form-fitting connection, is established between the securing device and the magazine component via the first coupling element of the magazine component and the second coupling element of the securing device. In particular, the magazine component has two first coupling elements and the securing device has two corresponding second coupling elements. A particularly secure coupling of the securing device to a magazine component can thus be achieved.

The first coupling element of the magazine component is designed, for example, as a recess, in particular as a through-hole without an internal thread, in a base frame of the magazine component. The first coupling element can also be designed as a hole with an internal thread or as a threaded pin.

The second coupling element of the securing device is adapted to the design of the first coupling element of the magazine component. The designs of the first coupling element and the second coupling element thus correspond to one another. In the case of a first coupling element designed as a through-hole without an internal thread, the second coupling element is designed in particular as a snap closure. The second coupling element then has a so-called adjusting sleeve, which consists of two mainly cylindrical part-sleeves with different diameters. A first part-sleeve has a first diameter, which allows the first part-sleeve to be pushed through the through-hole. A second part-sleeve has a second, larger diameter, which makes it impossible for the second part-sleeve to be pushed through the through-hole. In order to couple the securing device to the magazine component, the first part-sleeve is pushed through the through-hole until the second part-sleeve is in contact with the magazine component. A slide is arranged in the first part-sleeve and is pressed radially outwards by a spring. The slide has a bevel, via which a radially inwardly directed force is applied to the slide when the first part-sleeve is pushed through the through-hole, with the result that it is deflected when it is pushed through the through-hole into the first part-sleeve. After it has been pushed through, the slide is again pressed radially outwards by the spring, so that the slide prevents the first part-sleeve from being pulled back out of the through-hole. The snap closure and with it the securing device are thus coupled to the magazine component. The snap closure has a push button, arranged in particular on an end face of the second part-sleeve, via which the slide can be pulled back radially inwards into the first part-sleeve and the first part-sleeve can thus be pulled out of the through-hole of the magazine component. To decouple the securing device, the push button of the snap closure or closures is thus pressed and the securing device is pulled away from the magazine component. Snap closures of this type are cost-effective on the market and are available in various designs. The design of the second coupling element as a snap closure enables a particularly cost-effective securing element.

If the first coupling element is designed as a hole with an internal thread, then the second coupling element is designed in particular as a screw with an external thread, in particular as a wing screw. If the first coupling element is designed as a threaded pin, then the second coupling element is designed in particular as a nut with an internal thread, in particular a wing nut.

In an embodiment of the invention, the magazine housing device and the magazine component are designed such that the magazine housing device can house a plurality of magazine components. In the case in which the magazine housing device houses a plurality of magazine components, a securing device is only coupled to one magazine component. One or more magazine components, to which no securing device is coupled, are also secured on the magazine housing device via the single securing device mentioned. For this purpose, these magazine components, for example with the magazine component having the securing device, can be secured against displacement. The one securing device thus secures more than one magazine component on the magazine housing device. This means that a separate securing device is not required for each magazine component, which on the one hand is cost-effective and allows for a small installation space and low weight.

In an embodiment of the invention, the magazine housing device and the magazine component are designed such that the magazine housing device can house a plurality of magazine components. In the case in which the magazine housing device houses a plurality of magazine components, all of the magazine components housed by the magazine housing device have a first coupling element for coupling a securing device. The individual magazine components can therefore be used very flexibly. If necessary, the securing device can be coupled to each of the magazine components. The magazine components can therefore also all be designed in the same way, which enables the magazine components to be manufactured cost-effectively.

An assembly device usually includes more magazine components than can be arranged on the magazine housing device at the same time. The magazine components not arranged on the magazine housing device can then be equipped with assembly means, for example. In particular, all magazine components belonging to an assembly device have a first coupling element.

In an embodiment of the invention, the magazine housing device and the at least one magazine component are designed such that the at least one magazine component can be pushed onto the magazine housing device on a loading side of the magazine housing device. The securing device coupled to the at least one magazine component pushed onto the magazine housing device is arranged on the loading side of the magazine housing device. The magazine housing device has in particular a stop on a stop side opposite the loading side, which limits displacement of a magazine component relative to the magazine housing device. In the securing state of the securing device, the one magazine component or the plurality of magazine components are thus fixed between the aforementioned stop and the securing device and cannot be displaced with respect to the magazine housing device.

The aforementioned arrangement of the securing device on the loading side has the advantage that the securing device can be operated from the loading side, i.e. it can be brought into its securing state and its release state. This is particularly advantageous when the assembly device is used in a shaft and magazine components are pushed from the loading side onto the magazine housing device from a shaft opening, for example via a connecting web arranged between the shaft opening and the magazine housing device. In this case, the securing device can also be operated from the shaft opening, for example with the aid of an elongated rod. The rod has a length of between 1 and 3 m, for example.

In an embodiment of the invention, the securing device has a push rod lock with at least one, in particular two, movable push rods. The connection between the magazine component and the assembly frame can be produced via the aforementioned push rod. Push rod locks are cost-effective and are available in different variants on the market. The securing device can thus be produced in a particularly cost-effective manner.

A push rod lock converts a rotary movement of a rotary element into a translatory movement of two push rods. With their ends facing away from the rotary element, the push rods form the above-mentioned bolts, which penetrate into recesses in the magazine housing device when the securing device is in the securing state. The rotary element has, for example, a recess in the form of a square opening, via which the rotary element can be rotated and thus the push rods can be displaced outwards from the rotary element or inwards in the direction of the rotary element. By rotation of the rotary element, the securing device can thus be brought from the release state into the securing state and vice versa. The rotation of the rotary element can thus be viewed as an operation of the securing device. For this purpose, the above-mentioned elongated rod has at one end a contour corresponding to the square opening, so that the rotary element can be rotated by means of the rod, in particular also from a shaft opening. The rod is used by a fitter.

In an embodiment of the invention, the securing device is designed so that it can house assembly means, which component can be housed by means of the mechatronic installation component while an assembly step is being carried out. No space is therefore required in one of the magazine components for the assembly means housed by the securing device. These can then be made smaller and therefore also lighter and more cost-effective.

The securing device has one or more recesses on its upper side for housing assembly means, in particular tools such as drill bits or setting tools for driving in anchor bolts, into which the assembly means can be inserted from above. The assembly means can be picked up and removed upwards from the aforementioned recesses by the mechatronic installation component.

In an embodiment of the invention, the securing device and a first alignment device formed by the magazine housing device and the magazine component are designed and arranged in such a way that the securing device can only assume the securing state when a magazine component housed by the magazine housing device is aligned in a predetermined orientation with respect to the magazine housing device. A predetermined orientation should be understood here as meaning that a specific side of the magazine component is arranged on a predetermined side of the magazine housing device, for example on the stop side. The securing device can only be positioned in such a way that the aforementioned bolts can penetrate into recesses in the magazine housing device when the magazine component is aligned in the predetermined and therefore correct orientation with respect to the magazine housing device.

With this configuration, it is advantageously ensured that the arrangement of a magazine component can only be completed with the setting of the securing state of the securing device if the magazine component is aligned in the correct orientation with respect to the magazine housing device. The assembly device thus advantageously only carries out automated assembly steps when the magazine component is aligned in the correct orientation. This is particularly advantageous when the assembly means are not arranged symmetrically on the magazine component. For example, a magazine component may contain several rows of anchor bolts arranged next to each other, but only one row of drill bits. In this case, the mechatronic installation component can only remove the desired assembly means, i.e. an anchor bolt or a drill bit, from the magazine component if the magazine component is correctly oriented.

In an embodiment of the invention, the magazine component can be arranged in two possible orientations on the magazine housing device. The magazine housing device has a stop and the magazine component has a first side surface and an opposite second side surface. The stop and the two side surfaces are designed and arranged such that when the first side surface of the magazine component is in contact with the stop, the securing device can assume the securing state and when the second side surface of the magazine component is in contact with the stop, the securing device cannot assume the securing state. This enables a particularly simple and therefore cost-effective implementation of the first alignment device.

The magazine component is then arranged in the predetermined, correct orientation on the magazine housing device when the first side surface of the magazine component is oriented in the direction of the stop of the magazine housing device. The magazine component is therefore not arranged in the predetermined orientation and therefore is in an incorrect orientation on the magazine housing device when the second side surface of the magazine component is oriented in the direction of the stop of the magazine housing device. The aforementioned side surfaces are formed in particular by a housing plate of the magazine component. The stop and the side surfaces are designed in particular in such a way that the magazine component can be moved further in the direction of the stop in the correct orientation than in the incorrect orientation. For this purpose, the two side surfaces have projections of different sizes, in particular at different points, which, when a magazine component is pushed onto the magazine housing device, come into contact with the stop and thus determine a different distance between the magazine component and the stop depending on the alignment. In the correct orientation, the magazine component can in particular be displaced further in the direction of the stop than in the incorrect orientation.

In an embodiment of the invention, the securing device and a second alignment device formed by two magazine components housed one behind the other by the magazine housing device are designed and arranged so that the securing device can only assume the securing state when magazine components housed by the magazine housing device are aligned in a predetermined orientation with respect to the magazine housing device. This advantageously ensures that, when a plurality of magazine components are housed by the magazine housing device, all magazine components are arranged in the predetermined, correct alignment on the magazine housing device.

The second alignment device is formed in particular by opposing side surfaces of the two magazine components housed one behind the other by the magazine housing device, wherein in particular in each case the first side surfaces and second side surfaces thereof are identical. The side surfaces are designed and arranged such that the securing device can only assume the securing state when the second side surface of a first magazine component resting against the stop of the magazine housing device is arranged opposite a first side surface of the second magazine component. Setting the securing state of the securing device is not possible if the second side surface of a first magazine component resting against the stop of the magazine housing device is arranged opposite a second side surface of the second magazine component. This allows for a particularly simple and cost-effective implementation of the alignment device.

In other words, the securing device can only be brought into the securing state if a magazine component resting against the stop of the magazine housing device is correctly oriented and a magazine component adjoining this magazine component is also correctly oriented. In the case of magazine components arranged one behind the other, two of the same sides must not be opposite one another. In particular, the two magazine components can only be arranged so close to one another that the securing device can be brought into the securing state.

The above object is also achieved by a method for arranging a magazine component on a magazine housing device of an assembly device according to the above embodiments, in which the following steps are carried out:

- coupling a security device to a magazine component,
- arranging the magazine component on the magazine housing device, and
- setting the securing state of the securing device and thus establishing a connection between the magazine component and the assembly frame.

The aforementioned steps have already been described above in connection with the assembly device. The method has the same advantages as the assembly device.

When the assembly device is used in a shaft, the following further steps are carried out in particular:

- arranging a connecting web between a shaft opening of the shaft and the magazine housing device,
- pushing a magazine component from the shaft opening over the connecting web onto the magazine housing device, setting the securing state of the securing device from the shaft opening, and removing the connecting web.

In this way, magazine components can advantageously be pushed from a shaft opening onto the magazine housing device and secured. This enables the magazine components to be pushed on particularly easily and securely.

The connecting web is made, in particular, from metal. In particular, it is placed, on the one hand, on a support provided for this purpose on the magazine housing device and, on the other hand, on the shaft opening, in particular on a base of the shaft opening.

In particular, the magazine component is pushed onto the magazine housing device at least partially by means of an elongated rod. In addition, the securing state of the securing device is then set, i.e. the securing device is also operated by means of the aforementioned rod. The rod is used by a fitter. In this way, the magazine component can be pushed on and the securing state of the securing device can be set in a particularly simple and reliable manner.

Before the magazine component is pushed onto the magazine housing device, magazine components that have already been housed by the magazine housing device are at least partially removed by means of the aforementioned rod. This makes it particularly easy and safe to remove the magazine component. In particular, magazine components, from which the housed assembly means were removed while the assembly steps were being carried out, are removed.

Before the magazine components are removed, the securing device is first brought from the securing state into the release state by means of the rod. The magazine components are then pulled with the rod over the connecting web from the magazine housing device to the shaft opening.

It should be noted that some of the possible features and advantages of the invention are described herein with reference to different embodiments of the assembly device according to the invention and the method according to the invention. A person skilled in the art recognizes that the features can be combined, adapted, transferred or exchanged in a suitable manner in order to arrive at further embodiments of the invention.

Further advantages, features, and details of the invention will become apparent from the following description of embodiments and from the drawings in which identical or functionally identical elements are denoted with identical reference signs. The drawings are merely schematic and are not to scale.

DETAILED DESCRIPTION

Figure 1:
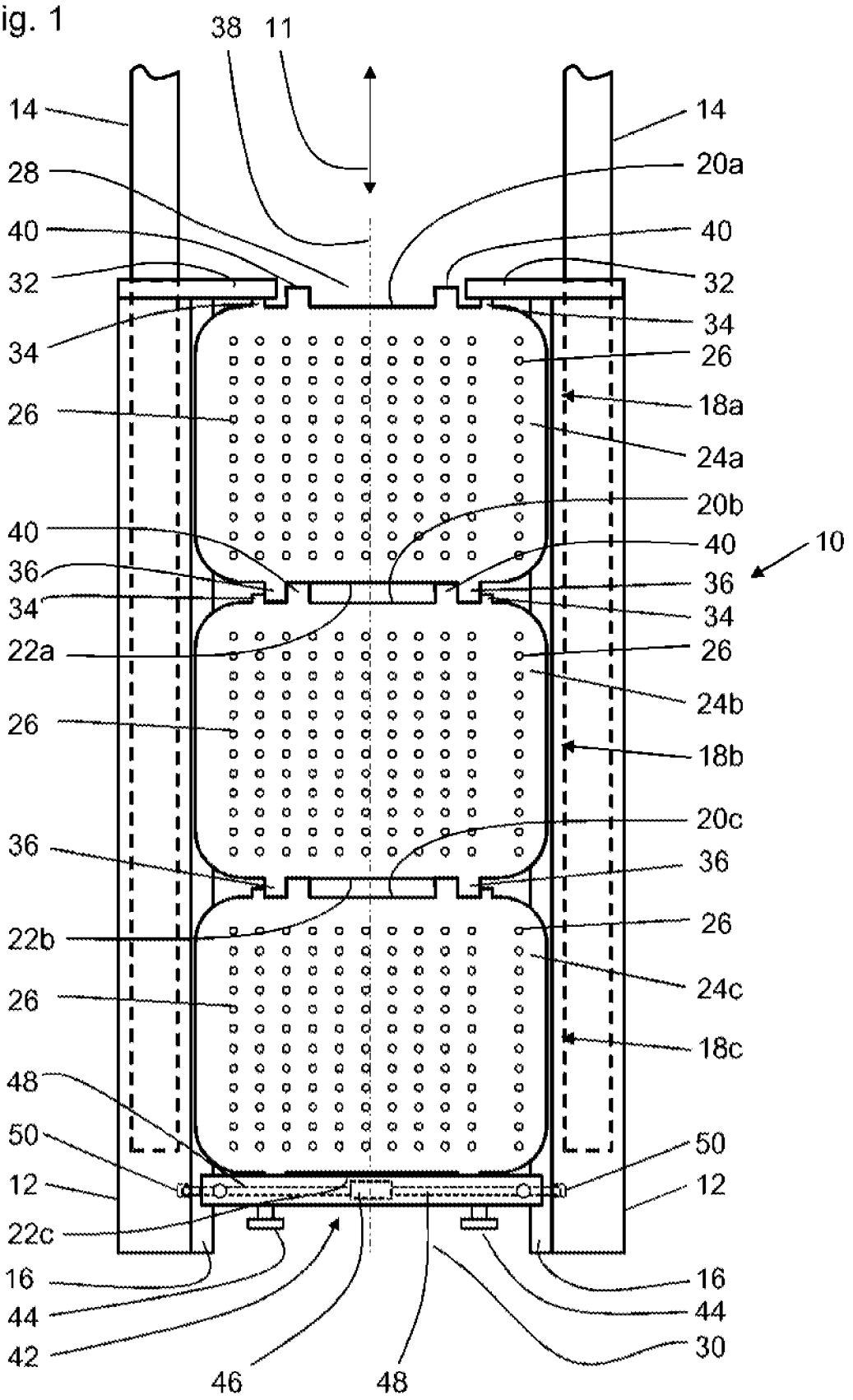
FIG. 1 shows a magazine housing device of an assembly device with three housed magazine components and a securing device in the securing state in a view from above.

According to FIG. 1 a magazine housing device 10 of an assembly device (72 in FIG. 5), not shown in FIG. 1, for carrying out assembly steps on a wall has two arms 12 running parallel in an extension direction 11, which arms are pushed onto two bars 14, also running parallel in the extension direction 11, of an assembly frame (82 in FIG. 5) of the assembly device (72 in FIG. 5) and are fixed on the bars 14 by fastening means, not shown. The arms 12 and thus the magazine housing device 10 can be fixed in different positions on the bars 14 with respect to the extension direction 11, with the result that their positions can be adapted to the current place of use. The arms 12 have a basic shape that is mainly in the form of a hollow cuboid, which enables the aforementioned pushing onto the bars 14. The bars 14 and thus also the arms 12 run mainly horizontally.

The arms 12 of the magazine housing device 10 have inwardly directed support surfaces 16 which extend over the entire length of the arms 12 in the extension direction 11. Between the two arms 12, three identically constructed magazine components 18*a*, 18*b*, 18*c* are arranged one behind the other in the extension direction 11 and are therefore housed by the magazine housing device 10.

Figure 2:
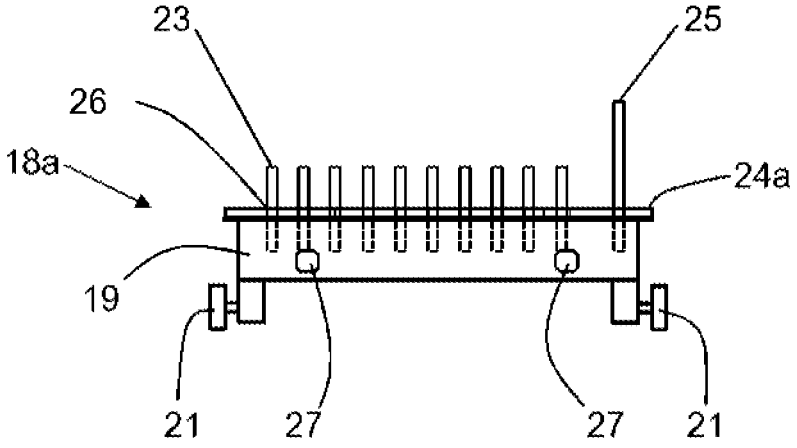
FIG. 2 shows a magazine component of FIG. 1 in a front view.

According to FIG. 2, the magazine component 18*a* has a mainly cuboid base frame 19 on which a total of four rollers 21 are arranged in the lower region, via which the magazine component 18*a* can be rolled over the support surfaces 16 and can be supported on them from above. When the magazine component 18*a* is rolled over the support surfaces 16, the four rollers 21 roll on the support surfaces 16. The base frame 19 carries a housing plate 24*a* on its upper side. The housing plate 24*a* has a large number of openings 26, into which assembly means in the form of anchor bolts 23 and drill bits 25 are inserted from above and can be removed, while an assembly step is being carried out with the assembly device (72 in FIG. 5), by a mechatronic installation component in the form of an industrial robot (84 in FIG. 5) of the assembly device (72 in FIG. 5). The base frame 19 has two first coupling elements in the form of two octagonal through-holes 27, which will be discussed in more detail below.

According to FIG. 1, the magazine components 18*a*, 18*b*, 18*c* each have a first side surface 20*a*, 20*b*, 20*c* and a second side surface 22*a*, 22*b*, 22*c* lying opposite in the extension direction 11. The first side surfaces 20*a*, 20*b*, 20*c* and the second side surfaces 22*a*, 22*b*, 22*c* of the magazine components 18*a*, 18*b*, 18*c* are each formed by a housing plate 24*a*, 24*b*, 24*c*, which is supported by the base frame (19 in FIG. 2), not shown in FIG. 1, of the magazine components 18*a*, 18*b*, 18*c*.

The first magazine component 18*a* is arranged on a stop side 28 and the third magazine component 18*c* is arranged on a loading side 30 of the magazine housing device 10. The second magazine component 18*b* is thus arranged between the first magazine component 18*a* and the third magazine component 18*c*. On the stop side 28 the magazine housing device 10 has two stops 32 which each extend inward from the two arms 12. The stops 32 are arranged at the same height as the housing plates 24*a*, 24*b*, 24*c*, so that the side surfaces 20*a*, 20*b*, 20*c*, 22*a*, 22*b*, 22*c* can come into contact with the stops 32. The stops 32 thus limit a displacement of the magazine components 18*a*, 18*b*, 18*c* in the direction of the stop side 28.

The first side surfaces 20*a*, 20*b*, 20*c* have two first projections 34. The first projections 34 are arranged in such a way that they come into contact with one of the stops 32 when the first side surface 20*a* of the first magazine component 18*a* is pushed in the direction of the stops 32, i.e. in the direction of the stop side 28. This orientation of the magazine component 18*a* is shown in FIG. 1. The second side surfaces 22*a*, 22*b*, 22*c* have two second projections 36. The second projections 36 are each arranged in such a way that they come into contact with one of the stops 32 when the second side surface 22*a* of the first magazine component 18*a* is pushed in the direction of the stops 32, i.e. in the direction of the stop side 28. This orientation of the magazine component 18*a* does not correspond to the representation in FIG. 1. The first projections 34 and the second projections 36 are each designed symmetrically with an axis of symmetry 38 running centrally between the two arms 12 of the magazine housing device 10 in the extension direction 11.

The second projections 36 extend further away from the magazine components 18*a*, 18*b*, 18*c* in the extension direction 11 than the first projections 34. In the orientation shown in FIG. 1, in which the first side surface 20*a* is oriented in the direction of stop side 28, the first magazine component 18*a* can thus be moved further in the direction of the stop side 28 than in the other possible orientation in which the second side surface 22*a* is oriented in the direction of the stop side 28. The orientation of the first magazine component 18*a* shown in FIG. 1 can be referred to as a predetermined or correct orientation. The stops 32, the first projections 34 and the second projections 36 together form a first alignment device.

The first side surfaces 20*a*, 20*b*, 20*c* also have two third projections 40 which cannot come into contact with the stops 32. The third projections 40 are arranged further inward toward the axis of symmetry 38 with respect to the first projections 34 and extend further away from the magazine components 18*a*, 18*b*, 18*c* in the extension direction 11 than the first projections 34. In this embodiment they extend the same distance away as the second projections 36 of the second side surfaces 22*a*, 22*b*, 22*c*. The third projections 40 on the first side surfaces 20*a*, 20*b*, 20*c* have such a large distance inward to the first projections 34 on the first side surfaces 20*a*, 20*b*, 20*c* that a second projection 36 of the second side surface 22*a* of the first magazine component 18*a* can be arranged between a first projection 34 and a third projection 40 of the second magazine component 18*b*. This orientation of the second magazine component 18*b*, in which its first side surface 20*b* is oriented in the direction of the second side surface 22*a* of the first magazine component 18*a* and thus in the direction of the stop side 28, can be referred to as a predetermined or correct orientation of the second magazine component 18*b*. This orientation is shown in FIG. 1. The third projections 40 are optional and therefore not absolutely necessary to ensure the correct orientation of the magazine components 18*a*, 18*b*, 18*c*.

If the second side surface 22*b* of the second magazine component 18*b* is oriented in the direction of the second side surface 22*a* of the first magazine component 18*a* and thus in the direction of the stop side 28, this can be referred to as an incorrect orientation. If the second magazine component 18*b* is displaced in the direction of the first magazine component 18*a* in this case, the two second projections 36 on the second side surface 22*a* of the first magazine component 18*a* meet the second projections 36 on the second side surface 22*b* of the second magazine component 18*b*. In this way, if the second magazine component 18*b* is not correctly oriented, the second magazine component 18*b* cannot be pushed as far in the direction of the first magazine component 18*a* as in the correct orientation of the second magazine component 18*b*. The second projections 36 thus form a second alignment device.

A securing device 42 is coupled to the third magazine component 18*c* via the first coupling element 27, not shown in FIG. 1, (see FIG. 2). The securing device 42 has a mainly cuboid basic shape and extends horizontally between the two arms 12 of the magazine housing device 10. The coupling to the third magazine component 18*c* takes place via two second coupling elements of the securing device 42 in the form of two snap locks 44, which will be discussed in more detail in connection with FIGS. 3 and 4. The securing device 42 has a centrally arranged push rod lock 46, by means of which two push rods 48 oriented outwards in the direction of the arms 12 of the magazine housing device 10 can be pushed outward and pulled inward. If, as shown in FIG. 1, all three magazine components 18*a*, 18*b*, 18*c* are arranged in the correct orientation on the magazine housing device 10, the securing device 42 is positioned opposite recesses 50 in the arms 12 such that outer ends of the push rods 48 can penetrate into the recesses 50. This produces a form-fitting connection between the securing device 42 and the arms 12 of the magazine housing device 10 and thus with the bars 14 of the assembly frame (82 in FIG. 5). This state of the securing device 42 is referred to as the securing state. The securing device 42 is in a release state when the push rods 48 are retracted inward or do not penetrate into the recesses 50 of the arms 12.

As soon as one of the three magazine components 18*a*, 18*b*, 18*c* is not arranged in the correct orientation on the magazine housing device 10, the securing device 42 is too great a distance from the stop side 28 of the magazine housing device 10 to be aligned with the recesses 50 of the arms 12 so that the push rods 48 can penetrate into the recesses 50. The securing device 42 can thus only be brought into the securing state if all three magazine components 18*a*, 18*b*, 18*c* have a predetermined and therefore correct orientation with respect to the magazine housing device 10.

Figure 3:
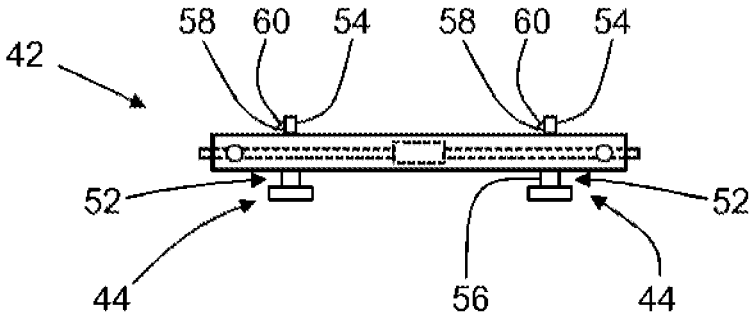
FIG. 3 shows a view of the securing device of FIG. 1 from above.

According to FIG. 3, the two snap closures 44 of the securing device 42 each have an adjusting sleeve 52, which consists of two mainly cylindrical part-sleeves 54, 56 with different diameters. The first part-sleeve 54 has a first diameter which allows the first part-sleeve 54 to be pushed through the through-hole 27 of one of the magazine components 18*a*, 18*b*, 18*c*. The second part-sleeve 56 has a second, larger diameter, which makes it impossible for the second part-sleeve 56 to be pushed through the through-hole 27. To couple the securing device 42 to a magazine component 18*a*, 18*b*, 18*c*, the first part-sleeve 54 is inserted through the through-hole 27 until the second part-sleeve 56 rests against the main body 19 of the magazine component 18*a*, 18*b*, 18*c*. A slide 58 is arranged in the first part-sleeve 54 and is pressed radially outwards by a spring, not shown. The slide 58 has a bevel 60 via which a radially inwardly directed force is applied to the slide 58 when the first part-sleeve 54 is pushed through the through-hole 27, whereby when it is pushed through the through-hole 27 it is deflected into the first part-sleeve 54. After the pushing through, the slide 58 is again pressed radially outward by the spring, so that the slide 58 prevents the first part-sleeve 54 from being pulled back out of the through-hole 27. The snap closure 44 and with it the securing device 42 are thus coupled to the magazine component 18*a*, 18*b*, 18*c*.

Figure 4:
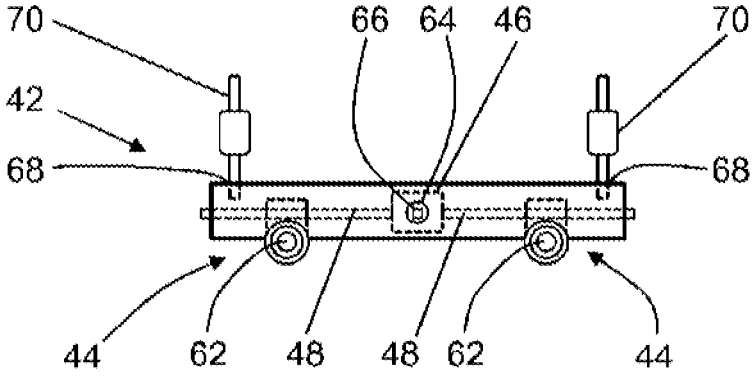
FIG. 4 shows a securing device of FIG. 3 in a view from the front and FIG. 5 shows an assembly device of FIG. 1 in an elevator shaft.

According to FIG. 4, the snap closures 44 of the securing device 42 each have a push button 62 which is arranged on an end face of the second part-sleeve 56 and via which the slide 58 can be pulled back radially inward into the first part-sleeve 54 and thus the first part-sleeve 54 can be pulled out of the through-hole 27 of the magazine component 18*a*, 18*b*, 18*c*. Thus, in order to decouple the securing device 42, the push button 62 of the snap closures 44 is pressed and the securing device 42 is pulled away from the magazine component 18*a*, 18*b*, 18*c*.

The push rod lock 46 of the securing device 42 has a rotary element 64 with a square opening 66, via which the rotary element 64 can be rotated and thus the push rods 48 can be displaced outward from the rotary element 64 or inward in the direction of the rotary element 64. The securing device 42 has two openings 68 on its upper side, into which an assembly means in the form of a setting tool 70 for driving in anchor bolts can be inserted from above and removed while an assembly step is being carried out.

Figure 5:
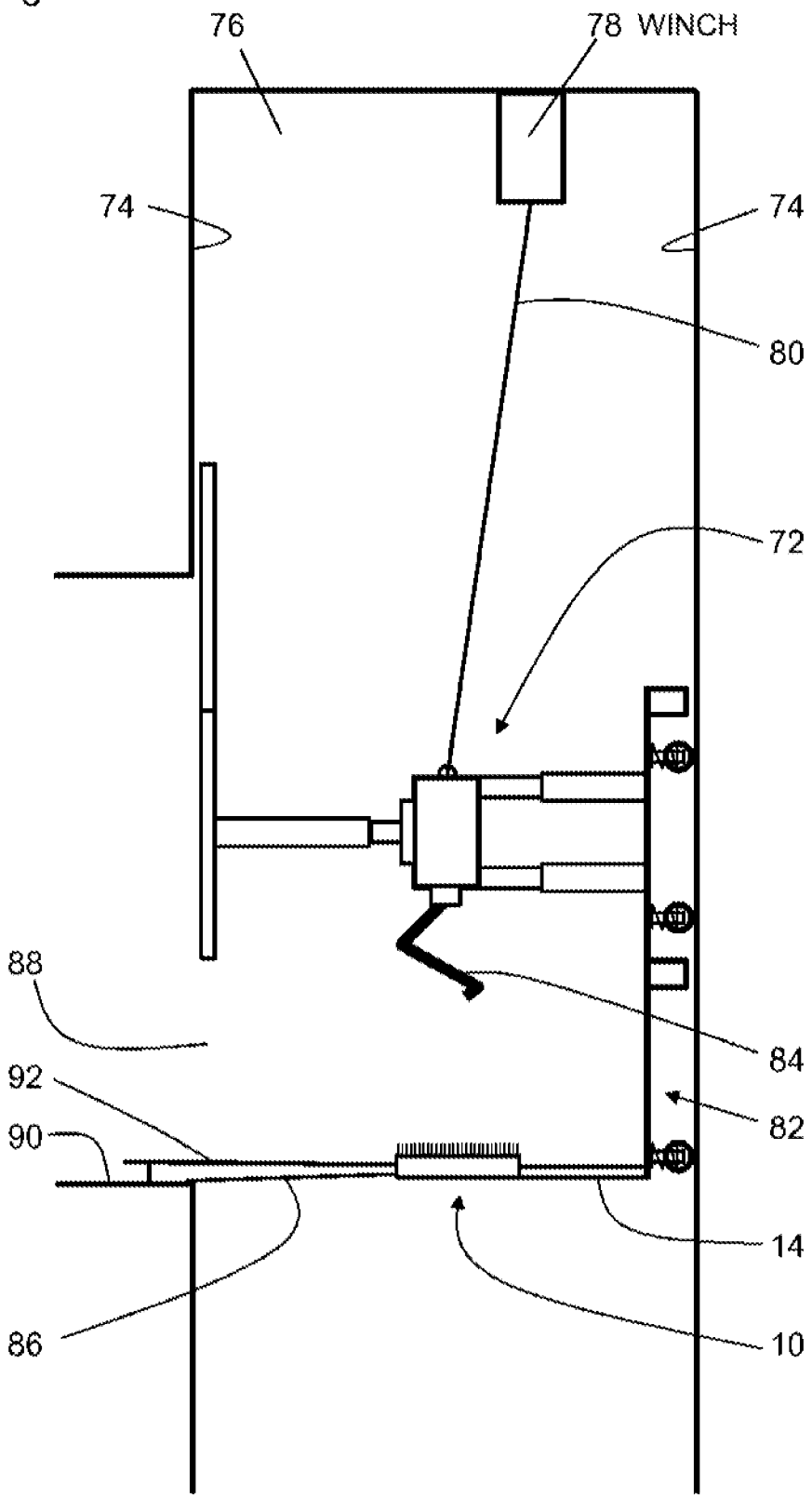

FIG. 5 shows an assembly device 72 for carrying out assembly steps on a wall 74 in a vertical shaft 76 in the form of an elevator shaft. A displacement component in the form of a winch 78 is arranged at the top of the shaft 76. The winch 78 is connected to an assembly frame 82 of the assembly device 72 via a carrier means in the form of a cable 80. The assembly frame 82 and thus the assembly device 72 can be displaced in the vertical direction in the shaft 76 by means of the winch 78 and the cable 80. The assembly frame 82 can be fixed in the shaft 76 so that it can assume a fixed position in the shaft 76. A mechatronic installation component in the form of an industrial robot 84 hanging downward is arranged at the top of the assembly frame 82. The industrial robot 84 can pick up various tools, such as a percussion drill, and use them to carry out automated assembly steps on the shaft walls 74, such as drilling a hole in a shaft wall 74. The two bars 14 shown in FIG. 1, which support a magazine housing device 10 according to FIG. 1, are arranged in the lower part of the assembly frame 82.

In order to arrange a new magazine component 18*a*, 18*b*, 18*c* according to FIG. 1 on the magazine housing device 10, a connecting web 86 is arranged between a base 90 of a shaft opening 88 of the elevator shaft 76 and the magazine housing device 10. The securing device 42 is then brought into its release state by a fitter, not shown, using an elongated rod 92. For this purpose, the rod 92 has a contour at one end that corresponds to the square opening 66 of the push rod lock 46. Then, with the rod 92, the "old" magazine components 18*a*, 18*b*, 18*c* located on the magazine accommodation device 10 are pulled via the connecting web 86 from the magazine housing device 10 onto the base 90 of the shaft opening 88. Then the securing device 42 is uncoupled from the "old" magazine component 18*c* and coupled to a "new" magazine component 18*c*. The "new" magazine components 18*a*, 18*b*, 18*c* are then pushed one after the other by the rod 92 from the base 90 of the shaft opening 88 via the connecting web 86 onto the magazine housing device 10. After the magazine components 18*a*, 18*b*, 18*c* have been pushed on, the securing device 42 is brought into the securing state by means of the rod 92. Because of the two alignment devices described, this is only possible if all magazine components 18*a*, 18*b*, 18*c* are arranged on the magazine housing device 10 in the correct orientation. Finally, the connecting web 86 is removed and the assembly device 72 can begin or continue to carry out assembly steps.

Finally, it should be noted that terms such as "having," "comprising," etc. do not preclude other elements or steps and terms such as "a" or "an" do not preclude a plurality. Furthermore, it should be noted that features or steps that have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An assembly device for carrying out assembly steps on a wall, the assembly device comprising:

a mobile assembly frame;

a mechatronic installation component;

a magazine housing device, the mechatronic installation component and the magazine housing device being arranged on the assembly frame;

a magazine component;

a securing device;

wherein the magazine housing device is adapted to house the magazine component with assembly means housed in the magazine component;

wherein the assembly means are removable from the magazine component by the mechatronic installation component when an assembly step is being carried out;

wherein the securing device, when in a securing state, establishes a connection between the magazine component and the assembly frame thereby securing the magazine component housed by the magazine housing device against displacement relative to the assembly frame;

wherein the magazine component has a first coupling element and the securing device has a second coupling element; and wherein the first coupling element and the second coupling element cooperate to detachably couple the securing device to the magazine component.

2. The assembly device according to claim 1 wherein the magazine component is a first magazine component, including a second magazine component having one of the first coupling element, wherein the magazine housing device is adapted to house the first and second magazine components, and the securing device is detachably coupled to only one of the first and second magazine components.

3. The assembly device according to claim 1 wherein the magazine housing device is adapted to house a plurality of the magazine component and the securing device is detachably coupled to only one of magazine components in the plurality.

4. The assembly device according to claim 1 wherein the magazine housing device has a loading side for receiving the magazine component being pushed onto the magazine housing device, and wherein the securing device couples to the magazine component pushed onto the magazine housing device at the loading side of the magazine housing device.

5. The assembly device according to claim 1 wherein the second coupling element of the securing device is a snap closure and the first coupling element of the magazine component is a through-hole corresponding to the snap closure.

6. The assembly device according to claim 1 wherein the securing device includes a push rod lock having at least one displaceable push rod, and the connection between the magazine component and the assembly frame is produced by the push rod.

7. The assembly device according to claim 1 wherein the securing device houses assembly means that can be picked up by the mechatronic installation component while an assembly step is being carried out.

8. The assembly device according to claim 1 wherein the securing device and a first alignment device, the first alignment device being formed by the magazine housing device and the magazine component, are arranged such that the securing device can only assume the securing state when the magazine component housed by the magazine housing device is aligned in a predetermined orientation with respect to the magazine housing device.

9. The assembly device according to claim 8 wherein the magazine component can be arranged in two different orientations on the magazine housing device and the magazine housing device has a stop; wherein the magazine component has a first side surface and an opposing second side surface, and wherein the stop and the two side surfaces are arranged such that:

when the first side surface of the magazine component is in contact with the stop, the securing device is enabled to assume the securing state; and when the second side surface of the magazine component is in contact with the stop, the securing device cannot assume the securing state.

10. The assembly device according to claim 8 wherein the securing device and a second alignment device, the second alignment device being formed by two of the magazine component housed one behind another by the magazine housing device, are arranged such that the securing device is enabled to assume the securing state only when the two magazine components are aligned in a predetermined orientation with respect to the magazine housing device.

11. The assembly device according to claim 10 wherein the second alignment device is formed by opposing side surfaces of the two magazine components housed one behind another by the magazine housing device, wherein the side surfaces are arranged such that the securing device is enabled assume the securing state only when the second side surface of a first of the two magazine components resting against the stop of the magazine housing device is arranged opposite a first side surface of a second of the two magazine components.

12. A method for arranging a magazine component on a magazine housing device of an assembly device according to claim 1, the method comprising the steps of:

coupling the securing device to the magazine component;

arranging the magazine component on the magazine housing device; and setting the securing state of the securing device thus establishing a connection between the magazine component and the assembly frame.

13. The method according to claim 12 including using the assembly device in a shaft by carrying out further steps of:

arranging a connecting web between a shaft opening of the shaft and the magazine housing device;

pushing the magazine component from the shaft opening over the connecting web onto the magazine housing device;

setting the securing state of the securing device from the shaft opening; and removing the connecting web.

14. The method according to claim 13 including using an elongated rod to push the magazine component onto the magazine housing device at least partially and to set the securing state of the security device.

15. The method according to claim 14 including, before pushing the magazine component onto the magazine housing device, at least partially removing another magazine component housed by the magazine housing device using the elongated rod.

* * * * *